United States Patent [19]

Branford

[11] Patent Number: 4,979,256

[45] Date of Patent: Dec. 25, 1990

[54] TOOTHBRUSH WITH MULTIPLE ROTARY BRUSH MEMBERS

[76] Inventor: William G. Branford, 1233 Laurelhurst, Eugene, Oreg. 97402

[21] Appl. No.: 362,103

[22] Filed: Jun. 6, 1989

[51] Int. Cl.[5] ..... A46B 13/00; A46B 7/10

[52] U.S. Cl. ..... 15/27

[58] Field of Search ..... 15/27, 167.1, 106, 110, 15/179, 23, 24, 25, 26; 128/62 A

[56] References Cited

U.S. PATENT DOCUMENTS

| | | | |
|---|---|---|---|
| 1,338,821 | 5/1920 | Eisner et al. | 15/27 |
| 2,220,053 | 10/1940 | Pruner | 15/27 |
| 2,274,778 | 3/1942 | Dantine | 15/179 X |

FOREIGN PATENT DOCUMENTS

| | | | |
|---|---|---|---|
| 829086 | 3/1938 | France | 15/27 |

*Primary Examiner*—Edward L. Roberts

*Attorney, Agent, or Firm*—James D. Givnan, Jr.

[57] ABSTRACT

A toothbrush having one or more wheel members with radially disposed bristles adapted to roll into contact with tooth surfaces. End plates on the wheel member inhibit bristle deflection. In a multiple wheel member version an intermediate wheel member serves to confine bristles against displacement. Side plates carry a spindle for the wheel member or members. A curved guard extends partially about the wheel members.

5 Claims, 1 Drawing Sheet

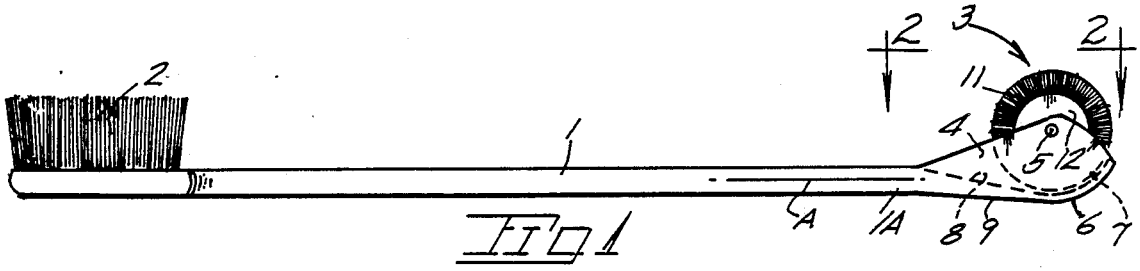
FIG. 1
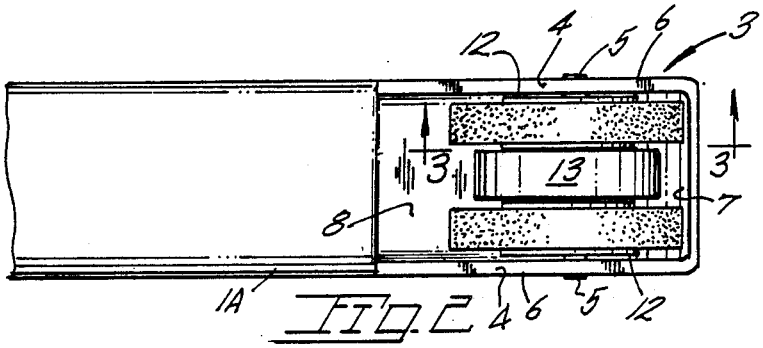
FIG. 2
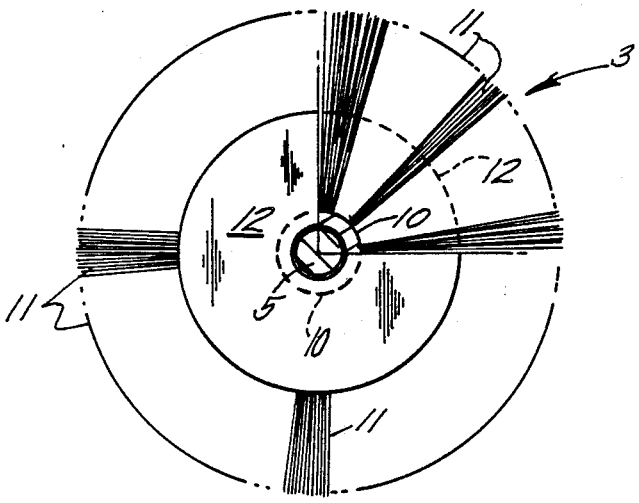
FIG. 3
FIG. 4
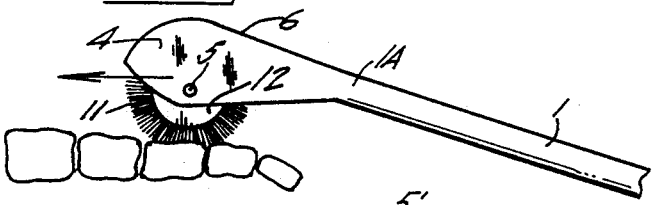
FIG. 5
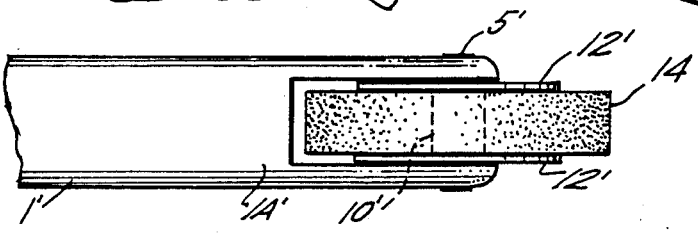

TOOTHBRUSH WITH MULTIPLE ROTARY BRUSH MEMBERS

Background of the Invention

The present invention pertains generally to toothbrushes of the type having a rotatable brush element.

The effectiveness of conventional bristle toothbrushes rapidly diminishes with brush use over a period of time as the bristles become too flexible and ineffective. Accordingly, bristle passage over tooth surfaces results in the shaft of the bristle wiping the tooth surface with diminished cleansing action. Conversely, provision of stiff brush bristles incurs the risk of abraiding tooth surfaces which over a period of time necessitates restoration efforts on the tooth.

In the prior art are toothbrushes either powered or manually operated which include rotary brush elements. U.S. Pat. No. 2,533,108 discloses a toothbrush wherein brush fibers are carried on a rotatable spindle with provision made for preventing pinching of the user's lip against a portion of the toothbrush handle. The prior art includes motorized toothbrushes driving one or more rotary brush elements as shown, for example, in U.S. Pat. No. 4,274,173. U.S. Pat. No. 4,317,463 discloses multiple rotary brushes mounted on parallel spindles for passage along inner and outer surfaces of the teeth and rotated by tooth contact. In the known prior art, the brush bristles or fibers are of a length making same susceptible to severe flexing and hence diminishing their cleaning action.

SUMMARY OF THE PRESENT INVENTION

The present invention is embodied within a toothbrush having brush wheels with each wheel provided with reinforced bristles.

The present toothbrush may include a conventional brush head at one end of a toothbrush handle with the remaining end modified to rotatably mount brush equipped wheels. Arm means extend outwardly from the handle to carry a spindle on which the brush wheels are mounted. Brush wheels include closely packed fibers the ends of which contact tooth surfaces as the wheel rolls thereover. Food particles, other debris and deposits are dislodged from tooth surfaces by the bristle ends impinging on the tooth surface. The bristles are supported by an intermediate wheel of a resilient nature against radical flexing.

Important provisions include the provision of a toothbrush wherein the bristles are provided in wheel configuration which roll over tooth surfaces resulting in endwise engagement of the brush bristles with tooth surfaces for efficient cleaning; the provision of a toothbrush wherein a multitude of brush wheels and a resilient wheel are provided for rotation about a spindle with a curved guard extending partially about the wheel circumference; the provision of brush wheels having end plates to inhibit bristle flexure.

BRIEF DESCRIPTION OF THE DRAWINGS

In the accompanying drawings.

FIG. 1 is a side elevational view of a toothbrush embodying the present invention;

FIG. 2 is a horizontal view taken downwardly along line 2—2 of FIG. 1;

FIG. 3 is a vertical sectional view taken along line 3—3 of FIG. 1; and

FIG. 4 is a fragmentary plan view showing the present toothbrush in use.

FIG. 5 is a fragmentary plan view of the end of a modified form of the present toothbrush.

DETAILED DESCRIPTION OF THE PREFERRED EMBODIMENTS

With continuing attention to the drawings wherein applied reference numerals indicate parts similarly hereinafter identified, the reference numeral 1 indicates a toothbrush handle which may include a brush head 2 of the conventional type.

An end portion lA of handle 1 carries wheel members indicated at 3. Side walls at 4 are integral with the handle and support a spindle 5. The side walls 4 are perpendicular to a plane containing the handle axis at A and merge with a guard 6 which extends outwardly, in an inclined manner, from handle portion lA with a curved guard segment at 7 fitting closely about an arc of the wheel periphery. Converging wall surfaces 8 and 9 of the guard result in a reduced wall thickness of the guard for minimal size to facilitate use of the present invention.

Each of the wheel members at 3, includes a hub 10 carried by spindle 5 with the wheel having bristles at 11 confined between end plates at 12. Said plates preferably extend radially at least one half of bristle length so as to retain the bristles against radical displacement during tooth contact.

An intermediate member located at 13 located between wheels 3 may be of somewhat lesser diameter than the wheel members and serves to prevent the bristles thereof from being severely displaced or flexed by tooth contact. Intermediate member 13 is preferably of circular shape and formed from a resilient material for non-damaging tooth and gum contact.

As shown in the view of FIG. 5 (similar to FIG. 2) the wheel member at 14 may be singular in a modified form of the invention wherein the guard is dispensed with. Parts identified with prime reference numerals correspond to parts earlier identified with like base reference numerals.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A toothbrush including, a handle including a spindle disposed transversely to the handle axis, and at least one wheel member rotatably mounted on said spindle, said member including a hub with spaced apart pairs of end plates, bristles confined between said pair of end plates, said bristles having a portion of their lengths confined between said pair of end plates to prevent radical bristle displacement thereby confining the bristles for endwise contact with the user's teeth, an additional wheel member on said spindle, and an intermediate member also on said spindle between said one wheel member and said additional wheel member, surfaces on the intermediate member serving to support the bristles of said one wheel member and said additional wheel member against lateral displacement during tooth and gum contact, said intermediate member being of a resilient nature.

2. The toothbrush claimed in claim 1 wherein said end plates are of a size so as to extend radially at least one half of bristle length.

3. The toothbrush claimed in claim 1 wherein said handle includes a pair of side plates supporting said spindle.

4. The toothbrush claimed in claim 1 wherein said handle includes a guard, said guard having converging surfaces and a curved segment extending partially about said wheel member.

5. A tooth including, a handle including a spindle disposed transversely to the handle axis, and wheel members disposed on said spindle including a first wheel member having radially disposed bristles for tooth cleaning, a second wheel member on said spindle and having resilient material, said second wheel member having a side wall proximate said first wheel member to confine the bristles of said first wheel member against radical flexure during contact with a tooth.

* * * * *

UNITED STATES PATENT AND TRADEMARK OFFICE

CERTIFICATE OF CORRECTION

PATENT NO. : 4,979,256

DATED : December 25, 1990

INVENTOR(S) : William G. Branford

It is certified that error appears in the above-identified patent and that said Letters Patent is hereby corrected as shown below:

Column 4, line 1, change "tooth" to - - - toothbrush - - -.

Signed and Sealed this

Twenty-third Day of February, 1993

*Attest:*

STEPHEN G. KUNIN

*Attesting Officer*

*Acting Commissioner of Patents and Trademarks*